US009732621B1

(12) United States Patent
Sexton et al.

(10) Patent No.: US 9,732,621 B1
(45) Date of Patent: Aug. 15, 2017

(54) AIR RIDING SEAL WITH PURGE CAVITY

(71) Applicants: Thomas D Sexton, Tequesta, FL (US); Jacob A Mills, Jupiter, FL (US)

(72) Inventors: Thomas D Sexton, Tequesta, FL (US); Jacob A Mills, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 394 days.

(21) Appl. No.: 14/548,492

(22) Filed: Nov. 20, 2014

(51) Int. Cl.
*F01D 11/00* (2006.01)
*F01D 11/02* (2006.01)
*F01D 11/10* (2006.01)

(52) U.S. Cl.
CPC ..... *F01D 11/025* (2013.01); *F01D 11/10* (2013.01); *F05D 2220/32* (2013.01)

(58) Field of Classification Search
CPC ..... F01D 11/025; F01D 11/00; F01D 11/001; F01D 11/003; F01D 11/02; F01D 11/04; F01D 11/06; F16J 15/443; F16J 15/441; F16J 15/34; F16J 15/3412; F16J 15/342
See application file for complete search history.

(56) References Cited

U.S. PATENT DOCUMENTS 4,523,764 A * 6/1985 Albers ..... F16J 15/342 277/400
8,066,473 B1 * 11/2011 Aho, Jr. ..... F01D 5/081 415/112

* cited by examiner

*Primary Examiner* — Richard Edgar
(74) *Attorney, Agent, or Firm* — John Ryznic

(57) ABSTRACT

An air riding seal for a turbine in a gas turbine engine, where an annular piston is axial moveable within an annular piston chamber formed in a stator of the turbine and forms a seal with a surface on the rotor using pressurized air that forms a cushion in a pocket of the annular piston. A purge cavity is formed on the annular piston and is connected to a purge hole that extends through the annular piston to a lower pressure region around the annular piston or through the rotor to an opposite side. The annular piston is sealed also with inner and outer seals that can be a labyrinth seal to form an additional seal than the cushion of air in the pocket to prevent the face of the air riding seal from overheating.

7 Claims, 3 Drawing Sheets

AIR RIDING SEAL WITH PURGE CAVITY

GOVERNMENT LICENSE RIGHTS

This invention was made with Government support under contract number DE-SC0008218 awarded by the Department of Energy. The Government has certain rights in the invention.

CROSS-REFERENCE TO RELATED APPLICATIONS

None.

BACKGROUND OF THE INVENTION

Field of the Invention

The present invention relates generally to a gas turbine engine, and more specifically to an air riding seal with a purge cavity in the turbine section of the engine.

Description of the Related Art Including Information Disclosed Under 37 CFR 1.97 and 1.98

In a gas turbine engine, compressed air from a compressor is burned with a fuel in a combustor to produce a hot gas stream that is then passed through a turbine to drive the compressor and, in the case of an industrial gas turbine engine, to also drive an electric generator to produce electrical power. The turbine typically includes several stages or rows of stator vanes and rotor blades. The stator therefore must be sealed from the rotor in order to prevent the hot gas from leaking into sections of the engine that must be protected from the high temperatures.

Labyrinth seals are the current choice of design for a seal between the rotor and the stator to prevent the hot gas from leaking into areas such as the rim cavity. A labyrinth seal (lab seal) typically will include a number of lab seal teeth extending from a rotor that forms a small gap with a surface on the stator.

One problem with lab seals in a gas turbine engine is that the gap between the teeth and the stator surface can change due to temperature changes in the turbine. Significant hot gas leakage not only decreases performance, but shortens part life. This is one reason why a honeycomb structure is used on the stator surface for the lab seal teeth to rub into. The teeth can rub without wearing out the teeth surface or the stator surface while minimizing any gap.

One improvement over the labyrinth seal in a turbine is the air riding seal disclosed in U.S. Pat. No. 8,066,473 issued to Aho J R on Nov. 29, 2011 (incorporated herein by reference). An air riding seal includes an annular piston that floats or rides over a rotor surface using a cushion of pressurized air. A near-perfect seal is formed between due to a very small gap formed between the rotor and the stator that is filled with pressurized air that prevents any leakage flow across the seal.

One of the challenges associated with the operation of the Aho air riding seal is that the leakage through one of the sealing lands can be so low that it leads to increased fluid temperature due to windage. This can lead to heat-up in the metallic seal, causing the metallic seal to expand and either rub or increase the leakage beyond what is desired. It can also lead to a much shorter seal life than anticipated. This low leakage is caused by the small pressure differential between the pocket pressure (cushion or pocket chamber 16 in the face of the annular piston 12 in the Aho patent) and the high pressure leakage cavity (19 in the Aho patent).

BRIEF SUMMARY OF THE INVENTION

In an effort to overcome the thermal problems that can be encountered on an air riding seal in a turbine, a purge cavity has been added. The purge cavity can be configured in two ways. In a first embodiment, air entering the purge cavity is vented out of the air riding seal piston in a radial direction through bypass holes into a downstream lower pressure region. In a second embodiment, the purge holes are in a rotating seal land. The purge cavity ensures that leakage flows move from inside the pocket (cushion chamber) lower pressure region, over the two coplanar sealing surfaces of the air riding seal piston, and then out through the purge cavity. These flows help to ensure that the face of the air riding seal piston stays cool and thus does not overheat.

In another embodiment, wherein the lower static secondary seal is removed and a labyrinth seal is allowed to seal directly onto the air riding seal piston. This simplifies the design by lowering the part count while also lowering the axial friction imparted onto the piston by the static secondary seals. Because the labyrinth seal has a large gap and is only utilized in transient, no abradable coating is needed on the air riding seal piston.

DETAILED DESCRIPTION OF THE INVENTION

Figure 1:
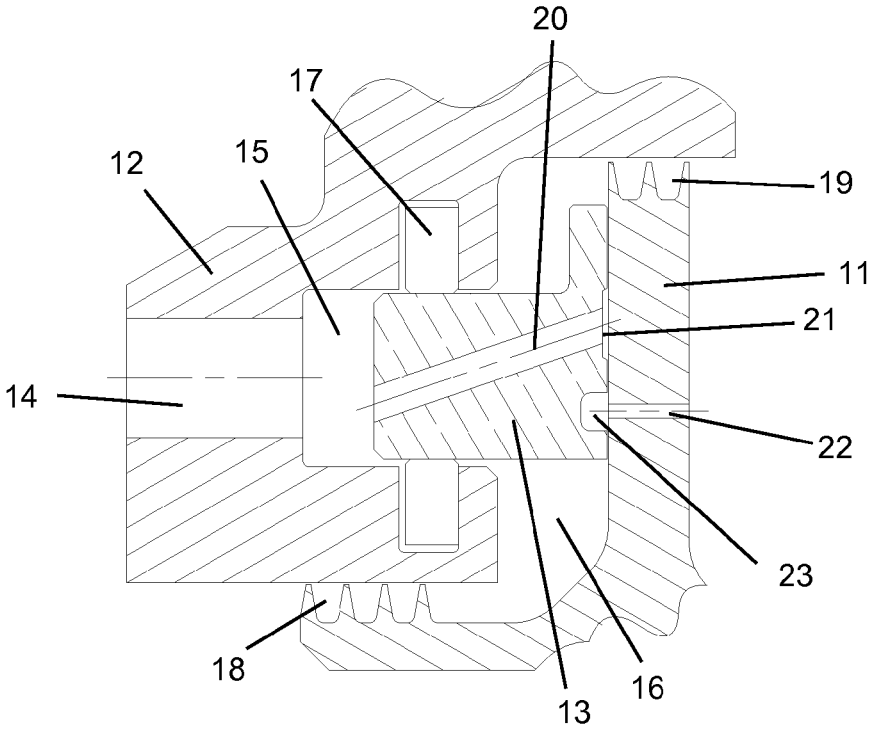
FIG. 1 shows a cross section view of a first embodiment of the air riding seal of the present invention.

The present invention is an air riding seal with a purge cavity used in a turbine of a gas turbine engine, especially for an industrial gas turbine engine. FIG. 1 shows a first embodiment of the present invention of the air riding seal with a purge cavity. An annular piston 13 floats within an annular chamber 15 formed within a stator 12 and rides over a surface of a rotor 11. The annular piston 13 includes a pocket or cushion chamber 21 that floats over the rotor surface due to pressurized air supplied from a supply passage 14 in the stator 12 that is connected to an annular arrangement of pressurized air supply passages 20 formed in the annular piston 13. A purge cavity 23 is formed on the air riding side of the annular piston 13 as in connected to an annular arrangement of purge holes 22 formed within the rotor 11. Inner and outer piston ring seals 17 supported in ring seal grooves formed in the stator provide for a seal against inner and outer surfaces of the annular piston 13. An inner labyrinth seal 18 and an outer labyrinth seal 19 forms another seal between the rotor 11 and the stator 12.

Pressurized air flows through the supply passage 14 an into the annular piston chamber 15, and then through the annular arrangement of supply holes 20 and into the pocket 21 to form a cushion of air for the air riding seal to float over the rotor 11 surface. Leakage of the air either flows radially outward over the upper seal land or flows radially inward where it collects in the purge cavity 23 and flows out through the purge holes 22 formed in the rotor 11.

Figure 2:
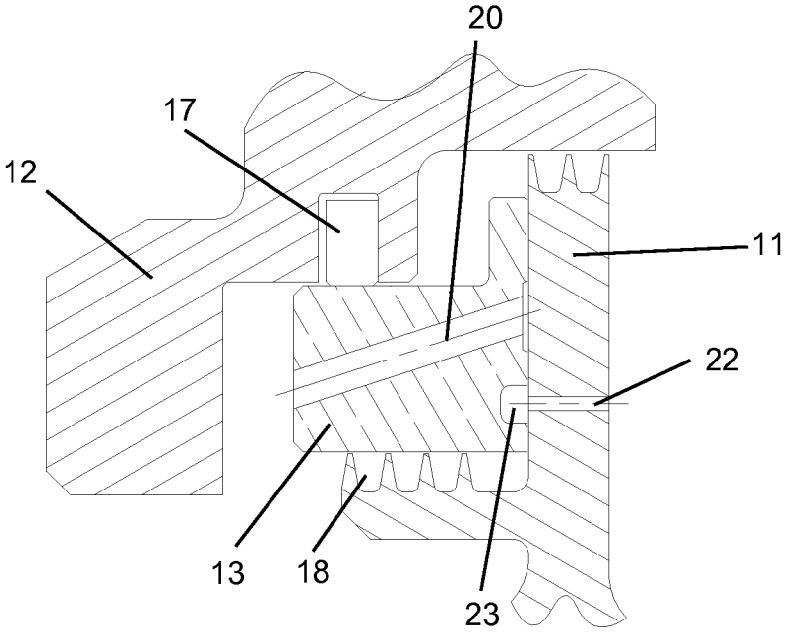
FIG. 2 shows a cross section view of a second embodiment of the air riding seal of the present invention.

FIG. 2 shows a second embodiment of the air riding seal similar to the FIG. 1 embodiment except the inner piston ring seal 17 is not used. the inner labyrinth seal 18 is used to form a seal with the inner surface of the annular piston 13.

Figure 3:
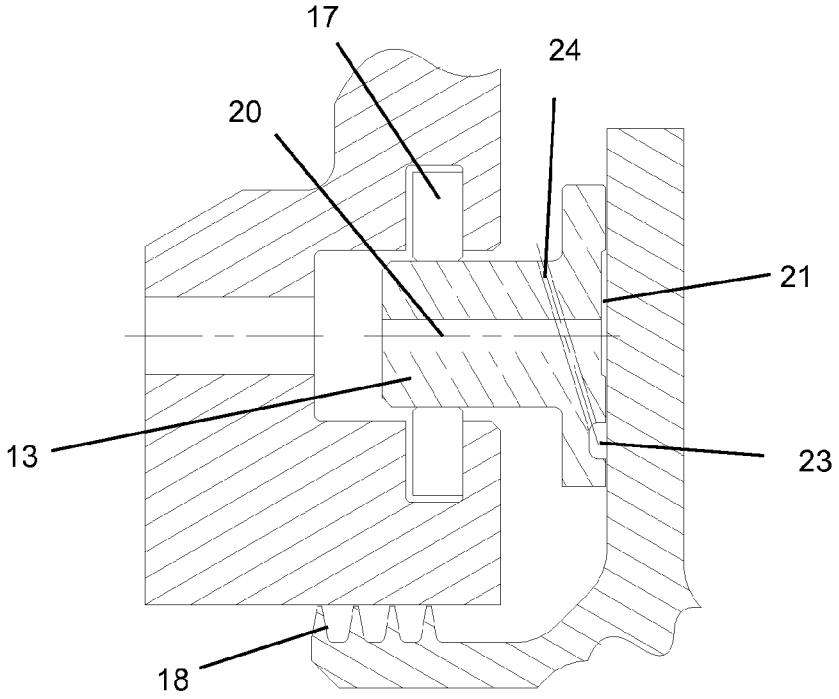
FIG. 3 shows a cross section view of a third embodiment of the air riding seal of the present invention.

FIG. 3 shows a third embodiment of the air riding seal in which an annular arrangement of bypass holes 24 formed in the annular piston 13 is used to purge the purge cavity 23. Thus, the pressurized air that flows into the pocket 21 and leaks into the purge cavity 23 will flow into the outer chamber radially outward of the annular piston 13.

Figure 4:
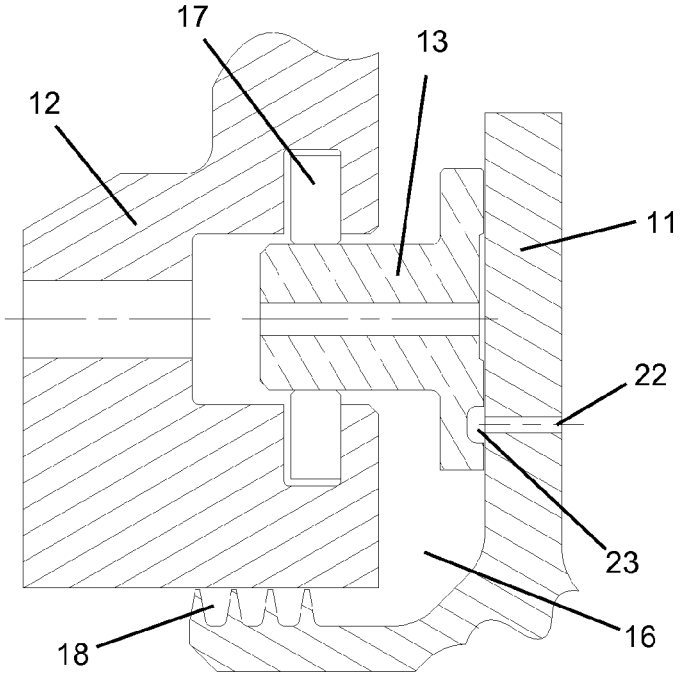
FIG. 4 shows a cross section view of a fourth embodiment of the air riding seal of the present invention.

FIG. 4 shows a fourth embodiment of the air riding seal where the purge holes 22 are formed in the rotor 11 and not in the annular piston 13.

Figure 5:
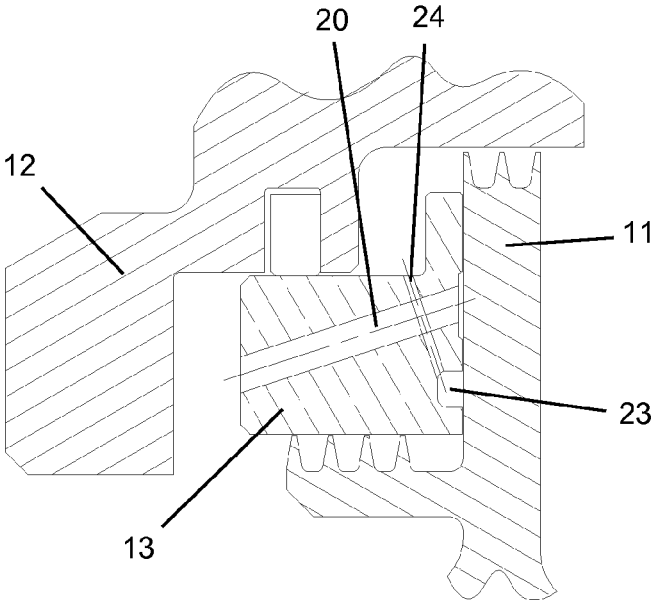
FIG. 5 shows a cross section view of a fifth embodiment of the air riding seal of the present invention.

FIG. 5 shows a fifth embodiment of the air riding seal where the purge holes 24 are formed in the annular piston 13 and the inner piston ring seal 17 is replaced with an inner labyrinth seal that forms a seal with the inner surface of the annular piston 13.

Figure 6:
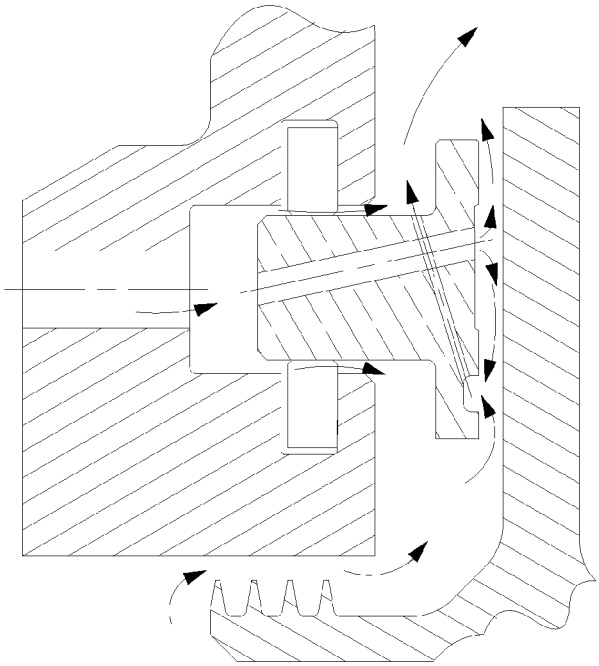
FIG. 6 shows a cross section view with flow paths for the FIG. 3 embodiment of the air riding seal of the present invention.

FIG. 6 shows the FIG. 3 embodiment of the air riding seal with the flow paths for the pressurized air. The pressurized air from the supply passage flows into the pocket to form a cushion of air between the annular piston and the rotor surface. The pressurized air within the pocket flows out and into the purge cavity. Some of the pressurized air that leaks past the inner labyrinth seal also flows into the purge cavity. The pressurized air that collects within the purge cavity 23 then flows through the purge holes and into the space radially outward of the annular piston. The pressurized air within the purge cavity and from the lower pressure region 16 around the air riding seal is thus discharged into the higher pressure region around the air riding seal to prevent hot gas flowing through the turbine from entering the inner region of the air riding seal or the pocket.

We claim the following:

1. A gas turbine engine with a turbine having a rotor and a stator exposed to a hot gas flow, the turbine comprising:

a rotor blade extending from the rotor;

a stator vane extending from the stator;

an annular piston axially moveable within an annular piston chamber formed within the stator;

the annular piston having a pocket connected to a source of compressed air to form a cushion of air with a surface of the rotor;

an outer seal in contact with an outer surface of the annular piston;

an inner seal in contact with an inner surface of the annular piston;

a purge cavity formed on the annular piston and facing the surface of the rotor;

the purge cavity connected to a purge hole that discharges compressed air collected within the purge cavity; and, the purge hole is formed in the rotor.

2. The gas turbine engine of claim 1, and further comprising:

the outer seal is a ring seal; and, the inner seal is a labyrinth seal.

3. The gas turbine engine of claim 2, and further comprising:

a labyrinth seal extending from the rotor and forming a seal with the stator radial outward of the annular piston.

4. The gas turbine engine of claim 1, and further comprising:

a labyrinth seal extending from the rotor and forming a seal with the stator radial inward of the annular piston.

5. A gas turbine engine with a turbine having a rotor and a stator exposed to a hot gas flow, the turbine comprising:

a rotor blade extending from the rotor;

a stator vane extending from the stator;

an annular piston axially moveable within an annular piston chamber formed within the stator;

the annular piston having a pocket connected to a source of compressed air to form a cushion of air with a surface of the rotor;

a purge cavity formed on the annular piston and facing the surface of the rotor;

the purge cavity connected to a purge hole that discharges compressed air collected within the purge cavity; and, the purge hole is formed in the rotor.

6. The gas turbine engine of claim 5, and further comprising:

a labyrinth seal extending from the rotor and forming a seal with the stator radial outward of the annular piston.

7. The gas turbine engine of claim 5, and further comprising:

a labyrinth seal extending from the rotor and forming a seal with the stator radial inward of the annular piston.

* * * * *